US005218177A

United States Patent [19]

Coleman, III et al.

[11] Patent Number: 5,218,177

[45] Date of Patent: Jun. 8, 1993

[54] SCREENED PATTERN CAUSING GAPS AROUND KEYBOARD MEMBRANE SPACER HOLE TO INCREASE VENTING AND REDUCE BOUNCE

[75] Inventors: Edwin T. Coleman, III, Versailles; Philip M. Cullen, Lexington; Mary L. VanArsdall, Georgetown, all of Ky.

[73] Assignee: Lexmark International, INc., Greenwich, Conn.

[21] Appl. No.: 805,409

[22] Filed: Dec. 10, 1991

[51] Int. Cl.[5] ..... H01H 13/70; H01H 9/02

[52] U.S. Cl. ..... 200/5 A; 200/306; 200/515

[58] Field of Search ..... 200/5 A, 512-517, 200/30 C

[56] References Cited

U.S. PATENT DOCUMENTS

| | | | |
|---|---|---|---|
| 4,018,999 | 4/1977 | Robinson et al. | 200/5 A |
| 4,046,975 | 9/1977 | Seeger, Jr. | 200/5 A |
| 4,065,649 | 12/1977 | Carter et al. | 200/5 A |
| 4,317,013 | 2/1982 | Larson | 200/5 A |
| 4,391,845 | 7/1983 | Denley | 427/58 |
| 4,456,798 | 6/1984 | Iwai et al. | 200/5 A |
| 4,701,579 | 10/1987 | Kurachi et al. | 200/5 A |

*Primary Examiner*—J. R. Scott
*Attorney, Agent, or Firm*—B. Franklin Griffin, Jr.

[57] ABSTRACT

First and second membranes carrying contacts located on opposing faces are separated by a third or spacer membrane having holes therein so that a circuit may be completed between the contacts when a force is applied to the first membrane. The first and second membranes and the peripheries of the holes define substantially enclosed switch regions. The first, second and third membrane layers are mechanically held together, without the use of adhesives, in the regions other than the switch regions. Spacer elements are provided between the spacer membrane and one of the first and second membranes. The spacer elements form air pockets such that air may flow between the switch region and the air pockets as the first membrane is depressed and then released. The arrangement provides two advantages. First, it reduces pressure buildup, such as would occur if the membranes were sealed together, when force is applied to the first layer. Secondly, it reduces pressure variations in the switch region where a vacuum would otherwise be created as the first membrane returns to its undepressed position. The contacts thus open more quickly thereby reducing the possibility of contact bounce. The spacer elements might be either conductive or dielectric. If they are conductive they may be applied during the same screening pass that places conductors and contacts on the first or second layer. If they are non-conductive they may be applied during the same screening pass that places a dielectric on the flex-tail portion of a membrane.

11 Claims, 2 Drawing Sheets

SCREENED PATTERN CAUSING GAPS AROUND KEYBOARD MEMBRANE SPACER HOLE TO INCREASE VENTING AND REDUCE BOUNCE

FIELD OF THE INVENTION

This invention relates to membrane keyboards and more particularly to a novel structure providing venting around membrane spacer holes to reduce contact bounce.

BACKGROUND OF THE INVENTION

A typical membrane keyboard of the prior art includes three membranes or layers of flexible sheet material. Electrical conductors are screened onto the bottom surface of the top layer and the top surface of the bottom layer. The center layer is provided with a plurality of holes including a hole at each switch site. The arrangement is such that when the top layer is depressed a conductor on its lower side makes contact with a conductor on the upper side of the bottom layer through a hole in the center layer.

Keyboards as described above may have an adhesive which seals the top and bottom layers to the center layer. This arrangement is not suitable for use in very low force (i.e. 5–15 grams) keyboards because pressure builds up in the sealed switch region as actuating force is applied to the top membrane. To overcome this problem some membrane keyboards have been constructed without the adhesive. The layers are not glued but are held together mechanically in regions remote from the switch sites. However, membrane keyboards of this type exhibit a hysteresis in that the displacement of the top layer in response to a force applied thereto is not the same when the top layer is depressed as when it is released. As the top layer is depressed, the pressure increases in the switch region bounded by the top and bottom layers and the edge of the hole in the center layer. This increased pressure tends to separate the top and bottom layers from the center layer because they are not glued together or mechanically held together in the switch region, and the air is dispersed into the regions between the layers. However, as the force on the top layer is released, the pressure in the switch region drops and the air begins to flow back between the layers to the switch region. This flow causes a reduced pressure between the layers which draws the bottom and top layers against the center layer in the region around the hole in the center layer. A vacuum is thus created in the switch region that retards the return of the top layer as the force on the top layer is released. This prevents a quick clean break of the contacts and may result in intermittent opening and closing of the contacts thus producing false signal levels. This is particularly true when the actuator for applying force to the top layer includes a buckling spring or rubber dome spring. Any bouncing of the spring causes a bouncing movement of the top layer. If the top layer is retarded by the vacuum in the switch region, it will be closer to the bottom layer during the bouncing and thus more likely to again make contact after the initial contact is broken. A similar problem exists in keyboard arrangements wherein the keystem acts directly against the top membrane. In this case rocking of the keystem by the operator, rather than spring bounce, may cause further contact after the initial contact is broken.

The prior art provides many solutions to the problem. In one approach, vent passages are formed in the upper or lower layers to permit free air flow between each switch region and the exterior of the keyboard. This solution has a disadvantage in that additional manufacturing steps are required to form vent passages in one or more of the layers. In a second approach, a maze of passages is formed in the center layer and interconnects the switch regions. The maze may be sealed off from the exterior environment on the theory that the volume change at one switch site as a result of pressing the top layer is insignificantly small compared to the total volume of all switch regions and the interconnecting passages so that the pressure in a switch region remains substantially constant. This arrangement requires a center layer which is hard to handle during assembly because of the many passage cut-outs. Also, since the assembly is sealed, the force required to close the contact increases or decreases as the pressure in the surrounding environment decreases or increases. In an extreme case, a high environmental pressure may cause switch actuation without any force being applied by an operator.

U.S. Pat. No. 4,317,013 solves the problem of pressure imbalance by dispensing with the center layer. Spacer areas are screened in a uniform pattern onto either the top or bottom layer, or both, and the top and bottom layers are glued together by glue applied to the spacer areas. A grid-like series of passages thus separates the top and bottom layers over their entire surfaces. This arrangement had the disadvantage that the spacer areas must be applied in a separate operation subsequent to the screening of the conductors onto the top and bottom layers because the spacers are also located over the switch contacts. Also, a further assembly step is required to apply the glue.

U.S. Pat. No. 4,391,845 also dispenses with the center layer and employs spacer areas which are screened onto the top or bottom layer. During a first pass the conductors and spacers are simultaneously screened onto a layer. Subsequent screening passes are then required to build up the thickness of the spacers because the thickness of the spacers after one screening pass is insufficient to reliably maintain a spacing between the conductors on the top and bottom layers.

SUMMARY OF THE INVENTION

An object of the present invention is to provide a membrane keyboard wherein a middle or spacer membrane having holes therein at switch sites separates two conductor-bearing membranes and spacers separate the middle membrane from at least one of the conductor-bearing membranes at regions adjacent to the holes to prevent formation of a vacuum in a hole as one conductor-bearing membrane moves away from the other. In a preferred embodiment the spacers comprise elements screened onto the same surface of one of the conductor-bearing membranes that carries the conductors. In a second embodiment the spacers may comprise elements located on the middle membrane in which case they may comprise screened-on projections or projections obtained by deforming the middle membrane.

Another object of the invention is to provide a keyboard as described above, wherein the spacers are screened onto one of the conductor-bearing membranes by a single screening pass during which other elements are screened onto the membrane. The spacers may be conductor material in which case they are screened onto a membrane during the same screening pass that the conductors are applied, or they may be dielectric material in which case they are screened onto a membrane during the same screening pass that the dielectric material is applied to a flextail of the membrane.

Still another object of the invention is to provide a keyboard wherein a spacer membrane having holes therein at switch sites is provided with individual spacers around the periphery of each hole, the projections being obtained by screening an ink onto the membrane or by deforming the membrane.

Other objects and advantages of the invention and its mode of operation will become apparent upon consideration of the following description and the accompanying drawings.

DETAILED DESCRIPTION OF THE INVENTION

Figure 1:
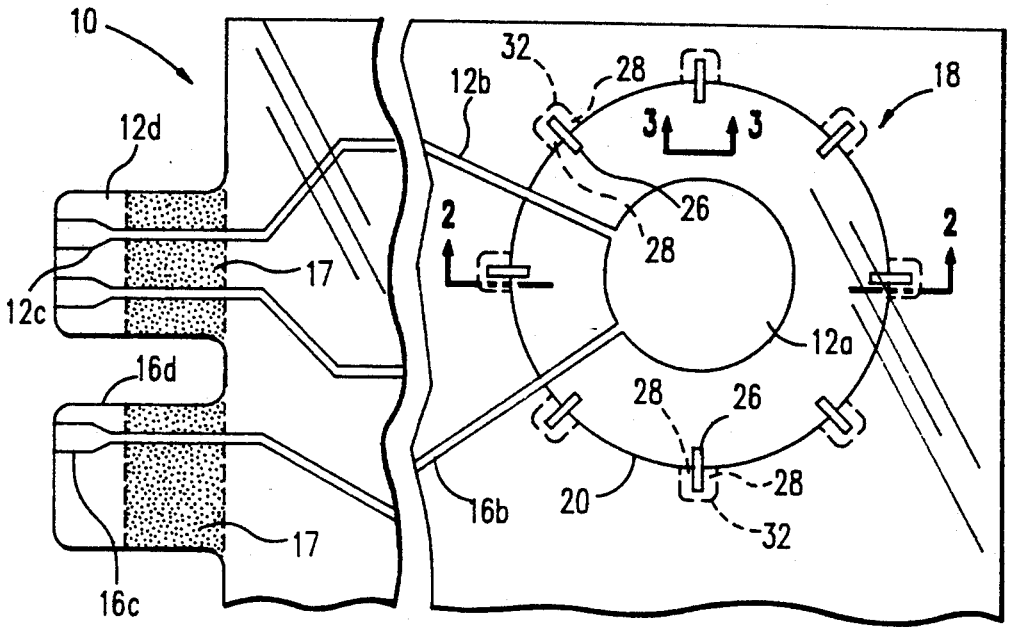
FIG. 1 is a top view, of a single keyboard switch site.
Figure 2:
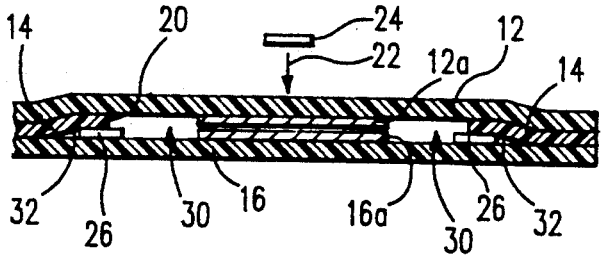
FIG. 2 is a part sectional view taken along the line 2—2 of FIG. 1.
Figure 3:
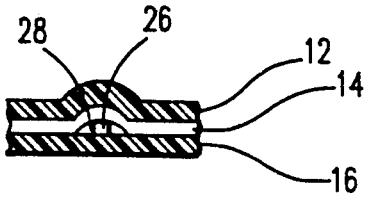
FIG. 3 is a part sectional view taken along the line 3—3 of FIG. 1.

FIGS. 1-3 show a portion of a keyboard 10 comprising a top or sense layer 12, a middle or spacer layer 14, and a bottom or drive layer 16 stacked one upon the other. The layers may comprise polyester (e.g. MYLAR) membranes which are secured in stacked relationship by a support means (not shown). The keyboard 10 has one or more switch sites 18, only one switch site being shown for purposes of illustration.

The spacer layer 14 has a plurality of holes 20 punched therein. There is one hole for each switch site.

At each switch site the top layer 12 has a switch contact 12*a* screened onto its bottom surface, that is, the surface facing spacer layer 14. It should be noted that since the layers 12, 14 and 16 may be transparent MYLAR, the contacts 12*a* are shown as visible through the top layer 12. The contacts 12*a* for the switch sites are interconnected in various combinations by conductors 12*b*. The conductors 12*b* connect with terminal pads 12*c* located on a flextail 12*d* which is an extension of layer 12 provided for connecting contacts 12*a* to external circuits. In like matter, the bottom layer 16 is provided with contacts 16*a* and conductors 16*b* on its upper surface as well as connector pads 16*c* located on a flextail 16*d*. The contact 16*a* is shown in FIG. 2 but is not visible in FIG. 1 because it is located directly behind the contact 12*a*.

A dielectric material 17 is applied to one surface of each flextail to cover and electrically insulate the portions of conductors 12*b* and 16*b* located on the flextails.

Switch contacts 12*a* and 16*a* are closed by applying a force in the direction indicated by arrow 22 (FIG. 2). The force applying means 24 may be a conventional key mechanism or merely a nomenclature sheet overlaying the layer 12 and having thereon an indication or identification of the switch. As force is applied to the top layer 12, it deflects contact 12*a* into the region bounded by the periphery of hole 20 and contact 12*a* completes an electrical circuit with the contact 16*a*. Upon release of the force, the flexible layer 12 returns to its initial position and the contacts 12*a* and 16*a* separate.

That portion of the switch structure described above is conventional. According to the present invention, several spacer elements 26 are provided between the middle layer 14 and one of the layers 12 and 16. As shown in FIGS. 2 and 3, the spacer elements are located between the middle layer 14 and the bottom layer 16 and extend radially into the region below hole 20. The spacer elements should extend inwardly at least as far as the periphery of hole 20 to insure that an air passage 28 extends along each side of each spacer element and communicates with the open switch region 30 between layers 12 and 16. Preferably, the spacers 26 extend inwardly beyond the periphery of hole 20 since this reduces registration requirements when the spacer elements 26 are formed as described below. As best seen in FIG. 1, the passages 28 meet at the radially outwardly ends of spacer elements 26 so that the spacer elements form pockets 32 into which air may flow from the switch region 30.

When force is applied to the top layer 12 to force it downwardly into the switch region 30, pressure tends to build up in region 30 and the air therein is forced into pockets 32. Since layers 14 and 16 are not affixed to each other, pockets 32 expand slightly in size as the air enters the pockets. When the force is released, the resiliency of layer 12 causes it to move upwardly, tending to reduce the pressure in the region 30. The air in pockets 32 flows into region 30 through passages 28 so that the pressure in region 30 rapidly increases thereby permitting the layer 12 to rapidly return to its initial position.

Figure 4:
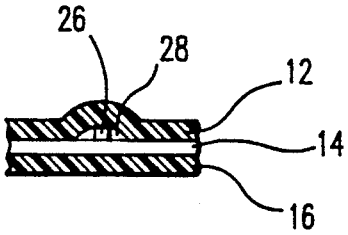
FIG. 4 is a sectional view, similar to FIG. 3, illustrating a second embodiment of the invention.

The space elements 26 need not be located between layers 14 and 16. They may be located between layers 12 and 14 as illustrated in FIG. 4. The spacer elements 26 may be a dielectric or a screenable conductive or non-conductive ink screened onto the upper surface of bottom layer 16, the bottom surface of top layer 12, or either surface of the middle layer 14.

It is preferred that the spacer elements 26 be screened onto either the top layer 12 or the bottom layer 16. When formed on one of these layers the spacer elements may be screened onto the layer without requiring an additional manufacturing step. For example, if the spacer elements 26 are to be located on the bottom surface of top layer 12, they may be screened onto the surface during the same screening pass that the dielectric 17 is applied to the flextail 12*d*, if the spacer elements are a dielectric material. If the spacer elements 26 are a conductive material they may be screened onto layer 12 during the same screening pass that applies conductors 12*b* and pads 12*c* to the layer. The same advantage is obtained if the spacer elements are screened onto the top surface of the bottom layer.

Figure 5:
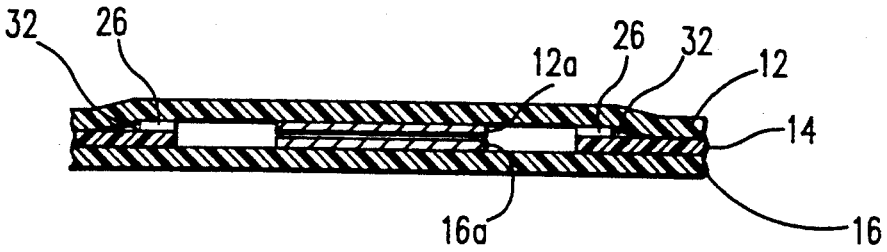
FIG. 5 is a part sectional view of an embodiment wherein spacers are screened onto a surface of the middle membrane.

Insofar as their functioning is concerned, the spacer elements 26 may be screened onto a surface of middle layer 14 as shown in FIG. 5 but this has the disadvantage of requiring an additional screening pass since layer 14 normally carries no conductors and has no dielectric applied thereto.

Figure 6:
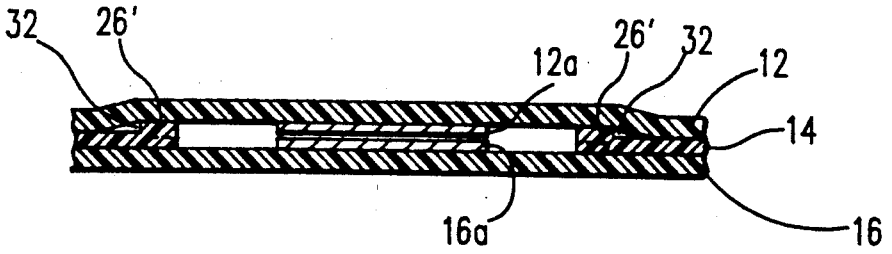
FIG. 6 is a part sectional view of an embodiment wherein spacers are formed by deformation of the middle membrane.

The spacer elements 26, rather than being applied to a surface of a layer, may comprise deformed portions of any one of the layers. For example, the middle layer may be pressed to deform it at spaced locations around the periphery of each hole 20, thereby creating projections 26, as shown in FIG. 6 which extend toward the top or bottom layer when the layers are stacked. Again, an additional manufacturing step is required when the spacer elements are formed in this manner.

The exact shape of spacer elements 26, the number of them, and the spacing between them does not affect their function but only the degree of venting of region 30. By way of example only, eight spacer elements may be located around each hole 20. Their vertical thickness (as viewed in FIG. 2) may be on the order of 0.03 mm. Their width may be on the order of 0.4 mm and their length about 3 mm.

From the foregoing description it is seen that the present invention provides a novel membrane keyboard structure which permits the use of a spacer membrane and at the same time alleviates the problem of vacuum build-up during key release without requiring venting channels in or through a membrane. Since a spacer membrane can be used, the structure does not require multiple screening passes in order to obtain adequate spacing between the switch contacts. Furthermore, some embodiments of the novel structure are obtained without requiring additional manufacturing steps.

While preferred embodiments of the invention have been described in specific detail, it will be understood that various substitutions and modifications may be made in the described embodiments without departing from the spirit and scope of the invention as defined by the appended claims. For example, it is obvious that the invention may be utilized in keyboards where each contact 16*a* comprises two segments through which a circuit is completed when a contact 12*a* engages both segments concurrently.

We claim:

1. A membrane keyboard comprising:

first, second and third electrically insulative layers, said third layer having a plurality of holes extending therethrough, said first and second layers having electrical contacts on one surface thereof, said first and second layers being disposed on opposite sides of, and adjacent to, said third layer whereby said first, second and third layers define a plurality of substantially enclosed switch regions, said layers being oriented with respect to each other such that when a force is applied to said first layer a contact thereon makes contact with a contact on said second layer through one of the holes in the third layer; and, a plurality of spacer elements disposed adjacent said switch regions and between said third layer and at least one of said first and second layers, each of said spacer elements separating said third layer from at least one of said first and second layers to form an air pocket communicating with the switch region adjacent thereto so that as said first layer is depressed and released air flows between one of said switch regions and the air pockets communicating therewith to thereby minimize pressure variations in said one switch region.

2. A keyboard as claimed in claim 1 wherein a plurality of spacer elements are disposed adjacent each of said switch regions.

3. A keyboard as claimed in claim 1 wherein said spacer elements extend into said switch regions.

4. A keyboard as claimed in claim 1 wherein said spacer elements comprise a screenable material.

5. A keyboard as claimed in claim 1 wherein said spacer elements comprise a dielectric material.

6. A keyboard as claimed in claim 1 wherein said spacer elements comprise a conductive material.

7. A keyboard as claimed in claim I wherein said spacer elements comprise a screenable material on the one surface of said first layer which carries said contacts.

8. A keyboard as claimed in claim 1 wherein said spacer elements comprise a screenable material on the one surface of said second layer which carries said contacts.

9. A keyboard as claimed in claim 1 wherein said spacer elements comprise a screenable material on one surface of said third layer.

10. A keyboard as claimed in claim 1 wherein said spacer elements comprise portions of said third layer which extend above a generally flat surface thereof at the edges of said holes.

11. A keyboard as claimed in claim 1 wherein said plurality of spacer elements comprise a first group of spacer elements disposed between said third layer and said first layer and a second group of spacer elements disposed between said third layer and said second layer.

* * * * *